United States Patent [19]

Maton

[11] 4,341,232

[45] Jul. 27, 1982

[54] TANK CLEANING APPARATUS

[75] Inventor: Maurice E. G. Maton, Sherfield English, England

[73] Assignee: Beaumont (U.K.) Limited, Hampshire, England

[21] Appl. No.: 192,848

[22] Filed: Oct. 1, 1980

[30] Foreign Application Priority Data

Oct. 3, 1979 [GB] United Kingdom ..... 7934281

[51] Int. Cl.[3] ..... B08B 9/08

[52] U.S. Cl. ..... 134/107; 134/168 R; 134/181; 239/227

[58] Field of Search ..... 134/107, 167 R, 168 R, 134/175, 177, 180–181, 198; 239/227

[56] References Cited

U.S. PATENT DOCUMENTS

| | | | |
|---|---|---|---|
| 1,557,240 | 10/1925 | Butterworth | 239/227 |
| 2,800,366 | 7/1957 | Scruggs | 239/227 X |
| 3,001,534 | 9/1961 | Grant, Jr. | 134/167 R |
| 3,140,828 | 7/1964 | Galanor | 134/107 X |
| 3,150,669 | 9/1964 | Green, Jr. | 134/167 R |
| 3,472,451 | 10/1969 | Orem et al. | 134/167 R X |
| 3,601,136 | 8/1971 | Marcham | 134/181 X |
| 3,895,756 | 7/1975 | Jaeger | 134/167 R X |

*Primary Examiner*—Robert L. Bleutge

*Attorney, Agent, or Firm*—Maky, Renner, Otto & Boisselle

[57] ABSTRACT

Apparatus for cleaning the interior of the tank comprising a spray head which can be inserted into the tank, the head having spray arms which are rotated about a vertical axis by a shaft driven by a motor and are rotated about a horizontal axis through only substantially 180 degrees by gears in mesh with gear racks carried by a frame connected by a piston rod to a piston movable within a cylinder attached to the underside of a plate which mounts the spray head to the tank, the spray head being fed selectively with water from a tank and chemical cleansing liquid from a tank by a valve controlled system which includes a heater for heating water and a heat exchanger for heating the chemical cleansing liquid, said system including a pressure pump for supplying the water and liquid to the spray head and a scavenge pump for removing liquid from the tank.

12 Claims, 3 Drawing Figures

TANK CLEANING APPARATUS

BACKGROUND OF THE INVENTION

This invention relates to apparatus for cleansing the interior of a tank and particularly, but not exclusively, apparatus for cleansing the interior of a tank of a bulk transporter tanker vehicle, such as a road haulage tanker vehicle for the transporting of milk or other liquids.

Such tanks are usually provided with an access hole (manhole) and are cleaned by spraying a liquid, such as water, into the tank by means of a hose. The cleaning operation is usually messy, involves a long time period and does not always clean the interior of the tank satisfactorily.

Spraying apparatus is known in which spray arms are bodily rotated through 360 degrees about an axis at a right angle to a vertical axis.

A disadvantage of the known apparatus is that material dislodged from the surface of the tank by the liquid sprayed from the rotating spray arms tends to be carried by the spray onto the already cleaned surface and again contaminates the surface.

SUMMARY OF THE INVENTION

This invention relates as aforesaid to apparatus for cleansing the interior of a tank.

According to the present invention there is provided apparatus for cleansing the interior of a tank, comprising a spray head which can be inserted into the tank, said head being provided with spray arms, means for rotating the spray arms bodily about a longitudinal axis of the head and means for rotating the spray arms about an axis normal to the longitudinal axis through only substantially 180 degrees during a washing cycle as the spray arms rotated about said longitudinal axis, said spray head being connected by a conduit to means for supplying water and/or chemical cleansing fluid under pressure to the spray head.

By only rotating the spray arms through substantially only 180 degrees during a washing cycle the spray forms a curtain which wipes along the surface being cleaned and moves dislodged material before it towards one end or bottom of the tank.

The spray head may comprise a cover plate for closing an access hole in the tank to be cleansed, a cylinder secured to the underside of said plate, a drive shaft extending longitudinally through the cylinder and through said plate, means for rotating said drive shaft, a piston in said cylinder and surrounding the drive shaft, a piston rod rotatably connected to the piston and extending from the lower end of the cylinder, a frame carried by said piston rod, means connecting the bottom end of the drive shaft to the frame to enable the frame to rotate with the shaft and drive means between the frame and the spray arms for causing the arms to rotate about an axis at right angles to the axis of the drive shaft during movement of the frame longitudinally of the drive shaft and relative thereto by movement of the piston within the cylinder.

An object of the present invention is to provide a cleansing apparatus which is efficient.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
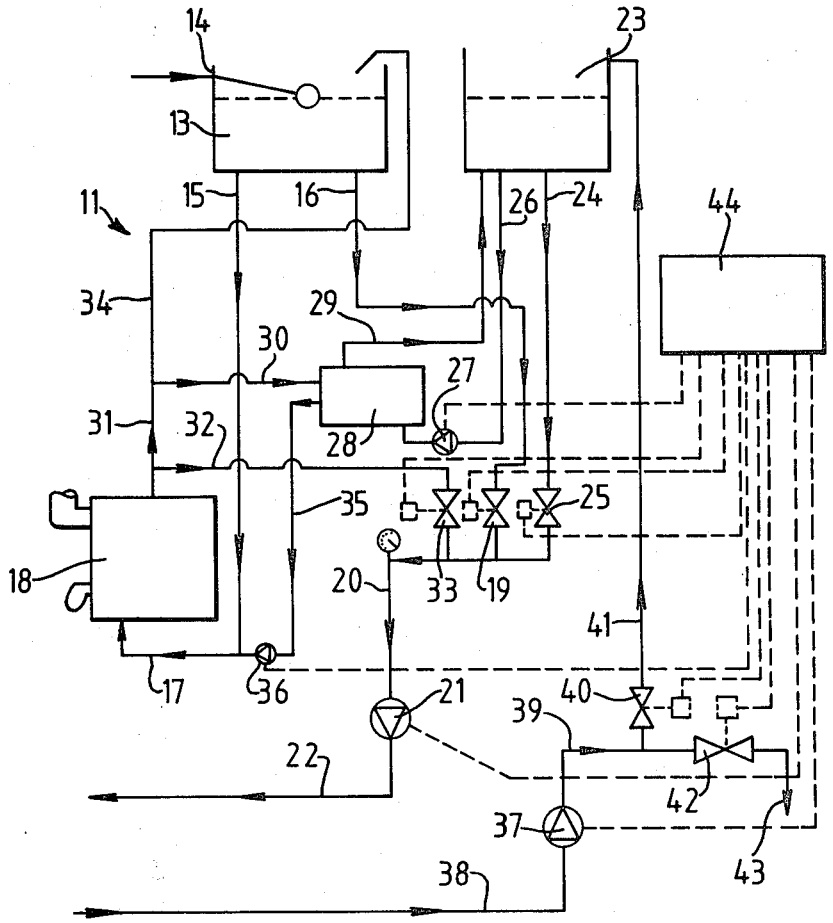
FIG. 1 is a diagrammatic illustration of a apparatus for pressurizing and heating the liquids fed to a spray head of the apparatus according to the invention.

The apparatus for cleansing the interior of a tank 10 comprises a static liquid supply system 11 and a spray head 12. The static system is shown in FIG. 1 and comprises a water storage tank 13 having a valve controlled inlet 14 and two outlet conduits 15 and 16. The outlet conduit 15 is connected to a conduit 17 which supplies water to a gas or oil fired water heating unit 18. The outlet conduit 16 is connected via a control valve 19 to a conduit 20 which is connected to a high pressure pump 21 which is preferably driven by an electric motor, the outlet side of the pump 21 being connected to a conduit 22 leading to the spray head 12.

The static system 11 also includes a storage tank 23 for a suitable chemical cleansing fluid. The tank 23 has an outlet conduit 24 connected via a control valve 25 to the conduit 20, and an outlet conduit 26 connected via a valve 27 to a heat exchanger 28. The heat exchanger 28 has an outlet conduit 29 which returns the chemical cleansing fluid heated in the heat exchanger 28 back to the tank 23. The heat exchanger 28 has an inlet conduit 30 which is connected to the water outlet conduit 31 from the boiler 18, the conduit 31 also being connected to a conduit 32 which is connected via a control valve 33 to the conduit 20. The conduit 31 is also connected to a vent conduit 34 which terminates above the tank 13. The heat exchanger 28 has a water outlet conduit 35 which is connected via a valve 36 to the conduit 17.

The assembly 11 also includes a scavenge pump 37 whose inlet side is connected to a conduit 38 leading to the drain connection of the tank 10. The outlet of the pump 37 is connected to a conduit 39 which is connected via a control valve 40 to a conduit 41 which is connected to the tank 23, and the conduit 39 is connected via a control valve 42 to a waste conduit 43.

All of the control valves of the assembly 11 are preferably electrically operated valves but they may be hydraulically or pneumatically operated and the valves and the drive motors of the pumps 21, 37 are controlled by a control unit 44.

Figure 2:
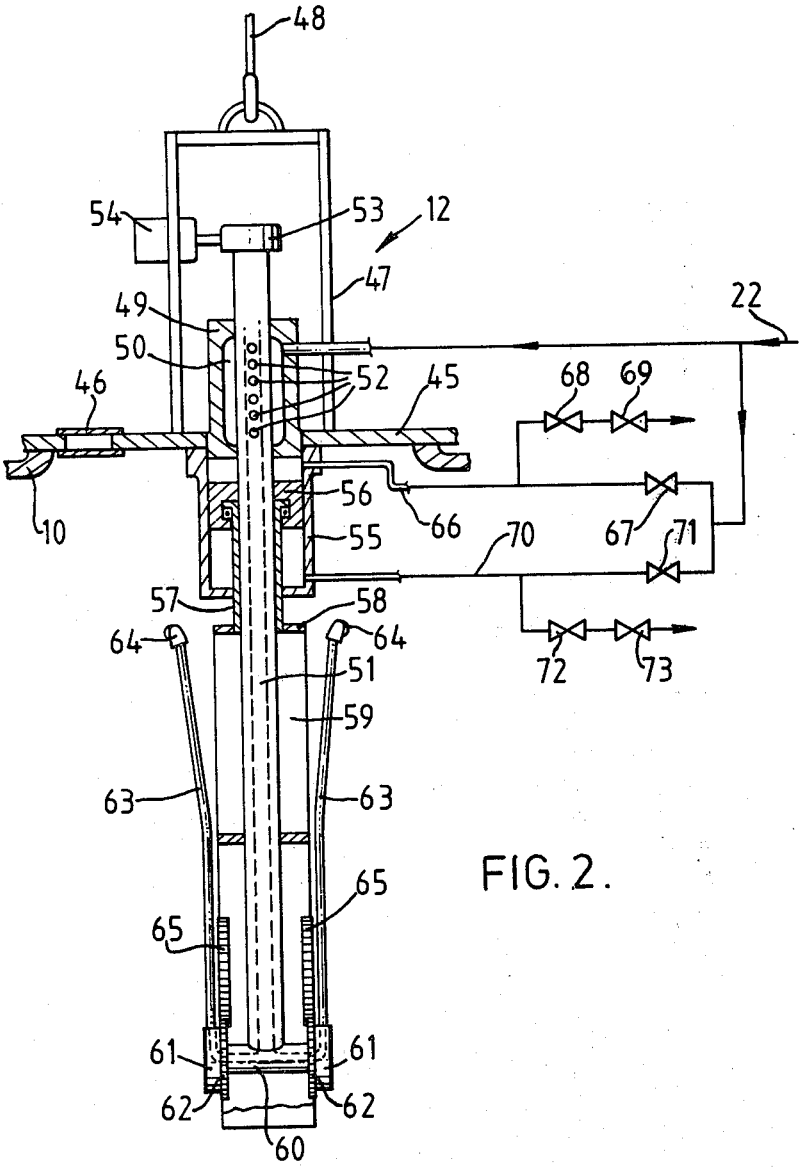
FIG. 2 is a longitudinal section through the spray head of a first embodiment of spraying apparatus of the present invention.

The spray head 12 shown in FIG. 2 has a mounting plate 45 which can be placed over the manhole of the tank 10 and secured thereto by bolts. The plate 45 is provided with an inspection window 46 to enable the operator to see into the tank 10 during the cleansing operation. Mounted on the top of the plate 45 is a structure 47 which can be connected to a lifting and lowering apparatus 48 used for lifting and lowering the spray head 12. Fixed to the plate 45 and extending upwardly therefrom is a member 49 having a chamber 50 formed therewithin. The chamber 50 is connected to the conduit 22 leading from the pump 21. Extending longitudinally through the member 49 is a hollow drive shaft 51 having ports 52 which connect the interior of the shaft 51 with the chamber 50. At its upper end the drive shaft 51 is connected to a drive head 53 through which the shaft 51 is rotated by means of a drive motor 54.

Fixed to the underside of the plate 45 is a cylinder 55 through which the shaft 51 extends. Mounted in the cylinder 55 and surrounding the shaft 51 is a piston 56. Rotatably connected to the piston 56 is a piston rod 57 to the lower end of which is connected a rectangular frame 58 having side walls 59 (only one of which is shown.) The shaft 51 extends within the frame 58 between the side walls 59, and the bottom of the shaft 51 is connected to a transverse member 60 on each end of which is rotatably mounted a rotor 61 having external gear teeth 62. Extending from each rotor 61 is a spray arm 63 provided at its other end with a spray nozzle 64. Each gear 62 is in mesh with a vertical gear rack 65 fixed to the side wall 59.

It will be appreciated that when the frame 58 is moved downwardly by the piston 56 the racks 65 will cause the rotors 61 to rotate, thus causing the spray arms 63 to rotate about the axis of the rotors 61 and that rotation of the shaft 51 will cause the frame 58 and the spray arms 63 to rotate about the axis of the shaft 51.

The upper end of the cylinder 55 is connected by a conduit 66 to the conduit 22 via a control valve 67 and the conduit 66 is also connected to waste by a regulating valve 68 and control valve 69.

The lower end of the cylinder 55 is connected by a conduit 70 via a control valve 71 to the conduit 22 and by a regulating valve 72 and control valve 73 to waste.

A suitable mode of operation of the apparatus shown in FIGS. 1 and 2 can be as follows.

The tank 10 can be subjected to a pre-wash or rinse to remove all of the initial deposits left in the tank 10. This can either be a cold water wash or a hot water wash. If this pre-wash or rinse is carried out with cold water then the valve 19 is opened to allow cold water to flow from tank 13 via conduits 16 and 20 to the pump 21. Cold water at high pressure is supplied by the pump 21 to the conduit 22 which flows into the chamber 50. The water then flows through the ports 52 and down the inside of the shaft 51 to conduits (not shown) which direct the water to flow into the arms 63, the water issuing as a spray from the nozzles 64. The motor 54 is operated to rotate the shaft 51 and thus the frame 58 and spray arms 63 are rotated about the axis of the shaft 51. The valve 67 is opened to allow the water to flow into the upper end of cylinder 55 and the valve 73 is opened to vent the lower part of the cylinder 55 below piston 56 to waste and thus the piston 56 will move downwardly thus moving the frame 58 downwardly and the racks 65 will drive the gears 62 causing the rotors 61 and the spray arms 63 to rotate about the axis of the rotors 61. The valve 42 is opened and the scavenge pump 37 allows the water sprayed into the tank, and removed particles, to be pumped to waste through conduit 43.

This pre-wash preferably takes place for 3 minutes and the pump 21 is then stopped. The scavenge pump 37 continues to operate for another 2 minutes in order to make sure that all of the water sprayed into the tank 10 is removed.

If the pre-wash or rinse is carried out with hot water then the valve 19 remains closed and water from tank 13 is conveyed by conduits 15 and 17 to the heater 18 where the water is heated and the hot water is conveyed via conduits 31 and 32 via the valve 33, which is open, to the conduit 20 and pump 21. Operation of the spray head 11 is as described for the cold rinse.

After the pre-wash or rinse has been completed the control 44 then automatically changes to a full wash cycle. This is a hot wash which can be repeated once or twice automatically. In this full wash cycle the cleansing fluid from tank 23 is conveyed via conduit 26 via open valve 27 to the heat exchanger 28 where it is heated in heat exchange relationship by hot water from the boiler 18 which flows into the boiler 18 via conduits 15 and 17, to the heat exchanger 28 via conduits 30, 31 and recirculated back to the heater 18 via conduit 35 and open valve 36. The heated cleansing fluid from heat exchanger 28 flows via conduit 29 back to the tank 23 and heated cleansing fluid is withdrawn from the tank 23 via conduit 24 and flows via open valve 25 and conduit 20 to the pump 21. Hot cleansing fluid is then conveyed by conduit 22 to the spray head 11 which operates as described above. The chemical cleansing fluid is removed from the tank 10 by the scavenge pump 37 and the valve 40 is open and valve 42 closed so that the scavenged cleansing fluid flows via conduit 41 back to the tank 23. Preferably, the conduit 41 includes a filter for removing debris from the scavenged cleansing fluid. With such a system no chemical cleansing fluid is lost. This wash cycle is again preferably carried out for 3 minutes and the pump 37 allowed to run for a further 2 minutes between washes or at the end of the wash.

The hot wash cycle is followed by a cold water rinse to rinse away all cleansing chemicals from the tank 10. At the end of the cold water rinse the pump continues to run for 2 minutes and is then stopped. This completes the wash cycle.

During the course of a 3 minute wash cycle the spray arms 63 rotate about the axis of the rotors 61 through substantially 180 degrees, i.e. from vertically upwards to vertically downwards and the sprayed liquid tends not only to pressure wash the wall surface of the tank 10 but to also wipe down the surface at the same time. The foreign matter on the wall surface is removed by the sprayed liquid and the moving curtain of sprayed liquid moves the foreign matter before it towards the bottom of the container where it is removed from the tank by the scavenge pump. During the 2 minutes scavenge period at the end of each wash the valves 69 and 73 are reversed and the piston is moved upwardly which causes the spray arms 63 to return to their starting position ready for the next phase of the washing cycle.

If the chemical cleansing fluid does not require to be heated then it could be supplied directly to the pump via conduit 24 and valve 25. In this case the valve 27 will be closed.

Figure 3:
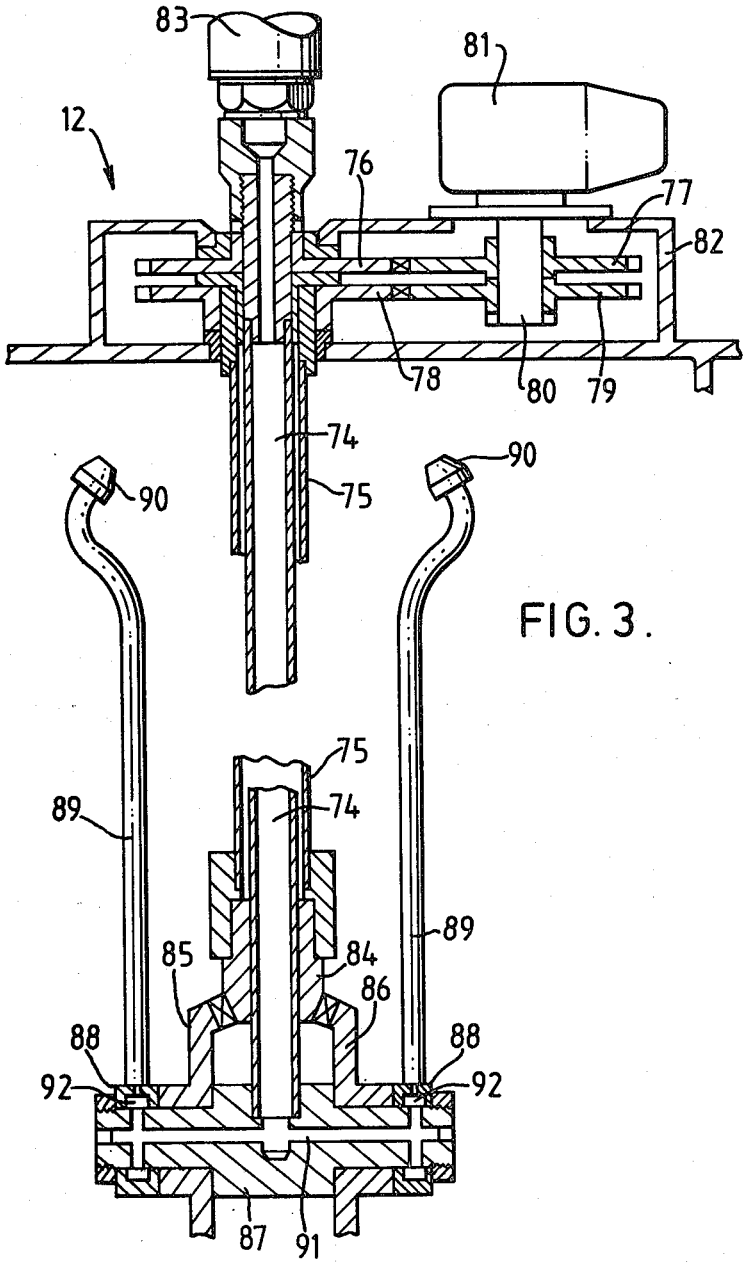
FIG. 3 is a longitudinal section through the spray head of a second embodiment of spraying apparatus of the present invention.

The embodiment of spray head 12 shown in FIG. 3 comprises two concentric shafts 74 and 75. The inner shaft 74 at its upper end is provided with a gear 76 which meshes with a gear 77 and the outer shaft 75 at its upper end is provided with a gear 78 which meshes with a gear 79. The gears 78 and 79 are mounted on a shaft 80 driven by a motor 81 which may comprise an electric motor or a hydraulic motor. Consequently the gears 78 and 79 are driven at the same speed. The gears 76–79 are housed in a gear housing 82.

The upper end of the shaft 74 is connected to a rotary coupling 83 through which the liquid from conduit 22 is supplied to the interior of the shaft 74.

At its lower end the outer shaft 75 is connected to a bevel gear 84 with which mesh two bevel gears 85 and 86 which are mounted for rotation on a support shaft 87 which extends at a right angle to the shaft 74 and is fixed to the lower end of the shaft 74. Fixed to the gears 85 and 86 are members 88 from which spray arms 89 extend, each arm 89 being provided at its outer end with a spray nozzle 90. Passageways 91 are provided in the shaft 87 which connect the interior of the inner shaft 74 with passageways 92 in the members 88 for conveying liquid to the interior of the spray arms 89.

The pitch and number of teeth of the gears 76–79 are chosen so that the shafts 74 and 75 rotate in the same direction of rotation but at different rotational speeds so that as the inner shaft 74 rotates the spray arms 89 bodily about the axis of the shaft 74 the outer shaft 75 through the bevel gears 84–86 rotate the spray arms 89 about the axis of the shaft 87 through substantially 180 degrees per washing cycle. Preferably the spray arms 89 are rotated through 184.59 degrees.

The change from one washing cycle to the next cycle can be accomplished automatically by use of a counter switch which counts the number of revolutions of the motor 81 and after a predetermined number of revolutions actuates the next wash cycle.

It will be appreciated that suitable means may be provided for raising and lowering the spray head.

While the preferred embodiments of the invention have been described, it will be obvious to those skilled in the art that various changes and modifications may be made without departing from the invention as defined in the appended claims.

I, therefore particularly point out and distinctly claim as my invention:

1. Apparatus for cleaning the interior of a tank, comprising a spray head insertable into such a tank, conduit means coupled to said spray head for supplying a washing fluid under pressure to said spray head, said spray head having at least one spray arm means for spraying such liquid therefrom, first drive means for rotating said spray arm means bodily about a longitudinal axis of the spray head, second drive means for rotating said spray arm means about an axis normal to the longitudinal axis and independently of the rotation effected by said first drive means, means for controlling the flow of fluid to said spray arm means so that during a washing cycle liquid flows from said spray arm means during only substantially 180° of rotation of said spray arm about the axis normal to the longitudinal axis from a substantially vertical position of said spray arm means and whilst said spray arm means is rotated through a plurality of rotations about the longitudinal axis.

2. Apparatus as claimed in claim 1, the washing fluid comprising water and/or chemical cleansing fluid.

3. Apparatus as claimed in claim 2, in which said spray arm means comprises plural spray arms and said spray head comprises two concentric shafts each arranged to be driven at one end by a motor through gearing in the same direction of rotation but at different speeds, the other end of the outer shaft having a bevel gear in mesh with second bevel gears mounted on a support shaft extending normal to the central shaft, said second bevel gears carrying respective spray arms.

4. Apparatus as claimed in claims 1 or 3, said means for controlling comprising means for permitting spraying during such 180 degree rotation and for preventing spraying during return of said spray arm means to a position thereof prior to such 180 degree rotation.

5. Apparatus as claimed in claim 2, including means for heating the water and/or chemical cleansing fluid.

6. Apparatus as claimed in claim 2, including means for selectively supplying water and chemical cleansing fluid and including a heater means for heating the water and a heat exchanger means for heating the chemical cleansing fluid, and means for connecting said conduit means to said means for selectively supplying.

7. Apparatus as claimed in claim 6, including means for supplying heated water from said heater means to said heat exchanger means and said heat exchanger means providing a heat exchange relationship of the heated water with the cleansing fluid.

8. Apparatus as claimed in claim 2, including means for scavenging fluid from such tank and conveying it to waste or to a reservoir tank for the cleansing fluid.

9. Apparatus for cleansing the interior of a tank, comprising a spray head which can be inserted into the tank, said head being provided with spray arms, means for rotating the spray arms bodily about a longitudinal axis of the head and means for rotating the spray arms about an axis normal to the longitudinal axis through only substantially 180 degrees during a washing cycle as the spray arms are rotated about said longitudinal axis, said spray head being connected by a conduit to means for supplying water and/or chemical cleansing fluid under pressure to the spray head wherein said spray head comprises a cover plate for closing an access hole in the tank to be cleansed, a cylinder secured to the underside of said plate, a drive shaft extending longitudinally through the cylinder and through said plate, means for rotating said drive shaft, a piston in said cylinder and surrounding the drive shaft, a piston rod rotatably connected to the piston and extending from the lower end of the cylinder, a frame carried by said piston rod, means connecting the bottom end of the drive shaft to the frame to enable the frame to rotate with the shaft and drive means between the frame and the spray arms for causing the arms to rotate about an axis at right angles to the axis of the drive shaft during movement of the frame longitudinally of the drive shaft and relative thereto by movement of the piston within the cylinder.

10. Apparatus as claimed in claim 9, in which each spray arm is carried by a rotor mounted on the drive shaft for rotation about an axis normal to the shaft, said rotor having a gear in mesh with a gear rack provided on the frame.

11. Apparatus as claimed in claim 9, in which a lifting structure is provided on the upper side of the plate for connection with lifting means.

12. Apparatus as claimed in claim 9, in which the drive shaft is hollow and is used for conveying water and/or cleansing fluid to the spray arms.

* * * * *